US007898514B2

(12) United States Patent
Kim

(10) Patent No.: US 7,898,514 B2
(45) Date of Patent: Mar. 1, 2011

(54) APPARATUS FOR DRIVING GATE OF LIQUID CRYSTAL DISPLAY AND DRIVING METHOD THEREOF

(75) Inventor: Sang Rae Kim, Kyoungsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1114 days.

(21) Appl. No.: 10/875,567

(22) Filed: Jun. 25, 2004

(65) Prior Publication Data

US 2005/0088391 A1 Apr. 28, 2005

(30) Foreign Application Priority Data

Oct. 24, 2003 (KR) ..... 10-2003-0074610

(51) Int. Cl.
*G09G 3/36* (2006.01)

(52) U.S. Cl. ..... 345/92; 345/94

(58) Field of Classification Search ..... 345/94–95
See application file for complete search history.

(56) References Cited

U.S. PATENT DOCUMENTS

| | | | | |
|---|---|---|---|---|
| 5,784,039 | A * | 7/1998 | Yasui et al. | 345/89 |
| 6,084,580 | A * | 7/2000 | Takahashi et al. | 345/211 |
| 6,421,038 | B1 * | 7/2002 | Lee | 345/98 |
| 2003/0117165 | A1 * | 6/2003 | Kim | 324/770 |

FOREIGN PATENT DOCUMENTS

| | | | |
|---|---|---|---|
| JP | 409120052 | A * | 10/1995 |
| KR | 10-0171956 | | 10/1996 |

* cited by examiner

*Primary Examiner* — Quan-Zhen Wang
*Assistant Examiner* — Calvin C Ma
(74) *Attorney, Agent, or Firm* — McKenna Long & Aldridge LLP

(57) ABSTRACT

A liquid crystal display including: a liquid crystal display panel having liquid crystal cells arranged in a matrix defined by data lines and gate lines that cross each other, wherein a thin film transistor is provided in each respective cell adjacent to a crossing of a data line and a gate line for the respective cell; a scanning voltage generator to generate at least two scanning voltages that have different values; a plurality of gate driving integrated circuits to generate scanning pulses using the scanning voltages and to supply the scanning pulse to the gate lines; and a switching circuit to switch the scanning voltages and to apply the scanning voltages to the gate driving integrated circuits.

4 Claims, 14 Drawing Sheets

APPARATUS FOR DRIVING GATE OF LIQUID CRYSTAL DISPLAY AND DRIVING METHOD THEREOF

This application claims the benefit of Korean Patent Application No. P2003-74610 filed in Korea on Oct. 24, 2003, which is hereby incorporated by reference.

BACKGROUND OF THE INVENTION

1. Field of the Invention

This invention relates to a liquid crystal display, and more particularly to a liquid crystal display and a driving method thereof to prevent deterioration of picture quality.

2. Description of the Related Art

Generally, a liquid crystal display (LCD) controls a light transmittance of a liquid crystal having a dielectric anisotropy using an electric field thereby displaying a picture. To this end, the LCD includes a liquid crystal display panel for displaying a picture and a driving circuit for driving the liquid crystal display panel. In the liquid crystal display panel, liquid crystal cells control light transmittance in accordance with pixel signals to thereby display a picture. The driving circuit includes a gate driver for driving gate lines of the liquid crystal display panel, a data driver for driving the data lines, a timing controller for controlling a driving timing of the gate driver and the data driver, and a power supply for supplying power signals required for driving the liquid crystal display panel and the driving circuit.

The data driver and the gate driver are separated into a plurality of integrated circuits (IC's) that are manufactured as chips. Each of the integrated drive IC's is mounted in an open IC area of a tape carrier package (TCP) or in a base film of the TCP by a chip on film (COF) system, and is electrically connected to the liquid crystal display panel by tape automated bonding (TAB) system. Alternatively, the drive IC may be directly mounted onto the liquid crystal display panel by a chip on glass (COG) system. The timing controller and the power supply are manufactured as a chip and mounted on a main printed circuit board (PCB).

The drives IC's connected to the liquid crystal display panel by the TCP are connected, via a flexible printed circuit (FPC) and a sub-PCB, to the timing controller and the power supply on the main PCB. More specifically, the data drive IC's receive data control signals and pixel data from the timing controller mounted onto the main PCB and power signals from the power supply by way of the FPC and the data PCB. The gate drive IC's receive gate control signals from the timing controller mounted onto the main PCB and power signal from the power supply by way of the PCB.

The drive IC's mounted onto the liquid crystal display panel by the COG system receive control signals from the timing controller mounted onto the main PCB and power signals from the power supply through the FPC and line on glass (LOG) type signal lines provided at the liquid crystal display panel. Even when the drive IC's are connected, via the TCP, to the liquid crystal display panel, the LCD adopts the LOG-type signal lines to eliminate the PCB, thereby having a thinner thickness. Particularly, the gate PCB delivering a relatively small number of signals is removed, and signal lines for applying gate control signals and power signals to the gate drive IC's are provided on the liquid crystal display panel in a LOG type. Thus, the gate drive IC's mounted in the TCP receives the control signals from the timing controller and the power signals from the power supply by way of the main PCB, FPC, the data PCB, the data TCP, the LOG-type signal lines and the gate TCP in turn. In this case, the gate control signals and the gate power signals applied to the gate drive IC's are distorted by line resistances of the LOG-type signal lines, thereby causing quality deterioration in a picture displayed on the liquid crystal display panel.

FIG. 1 is a schematic plan view showing a configuration of a related art line on glass (LOG) type liquid crystal display. As shown in FIG. 1, a LOG-type LCD having no gate PCB includes a main PCB 20 having a timing controller 22 and a power supply 24, a data PCB 16 connected, via a FPC 18, to the main PCB 20, a data TCP 12 having a data driving IC 14 connected between the data PCB 16 and liquid crystal display panel 6, and a gate TCP 8 having with a gate driving IC 10 connected to the liquid crystal display panel 6.

In the liquid crystal display panel 6, a thin film transistor array substrate 2 and a color filter array substrate 4 are joined to each other and have a liquid crystal therebetween. Such a liquid crystal display panel 6 is provided with liquid crystal cells driven independently by respective thin film transistors, which are adjacent to where gate lines GL and data lines DL cross each other. More particularly, the thin film transistor applies a pixel signal from the data line DL to the liquid crystal cell in response to a scanning signal from the gate line GL.

The data drive IC 14 is connected, via the data TCP 12 and a data pad of the liquid crystal display panel, to the data line DL. The data drive IC 14 converts a pixel data into an analog pixel signal and applies it to the data line DL. The data drive IC 14 receives a data control signal, a pixel data and power signals from the timing controller 22 and the power supply 24 mounted onto the main PCB 20 by way of the data PCB 16 and the FPC 18.

The gate drive IC 10 is connected, via the gate TCP 8 and a gate pad of the liquid crystal display panel 6, to the gate line GL. The gate drive IC 10 sequentially applies a scanning signal having a gate high voltage VGH to the gate lines GL. Further, the gate drive IC 10 applies a gate low voltage VGL to the gate lines GL in the remaining interval excluding a time interval when the gate high voltage VGH has been supplied.

The gate control signals and the power signals from the timing controller 22 and the power supply 24 on the main PCB 20 are applied, via the FPC 18 and the data PCB 16, to the data TCP 12. The gate control signals and the power signals applied via the data TCP 12 are applied, via a LOG-type signal line group 26 provided at the edge area of the thin film transistor array substrate 2, to the gate TCP 8. The gate control signals and the power signals applied to the gate TCP 8 are input via input terminals of the gate drive IC 10. Further, the gate control signals and the power signals are outputted via output terminals of the gate drive IC 10, and applied, via the gate TCP 8 and the LOG-type signal line 26, to the gate drive IC 10 mounted in the next gate TCP 8.

The LOG-type signal line group 26 includes signal lines for supplying direct current driving voltages from the power supply 24, such as a gate low voltage VGL, a gate high voltage VGH, a common voltage VCOM, a ground voltage GND and a base driving voltage VCC; and gate control signals from the timing controller 22, such as a gate start pulse GSP, a gate shift clock signal GSC and a gate enable signal GOE. Such a LOG-type signal line group 26 is formed from the same gate metal layer as the gate lines at a specific pad area of the thin film transistor array substrate 2 in a fine pattern. Further, the LOG-type signal line group 26 is in contact with the gate TCP 8 at contact portion A, which has a contact resistance. Thus, the LOG-type signal line group 26 has a larger line resistance than signal lines on a gate PCB. This line resistance distorts gate control signals (i.e., GSP, GSC and GOE) and power signals (i.e., VGH, VGL, VCC, GND and VCOM) transmitted via the LOG-type signal line group 26, thereby generating a horizontal stripe and/or stain, which causes a deterioration of picture quality, such as cross talk in a dot pattern and a greenish hue.

FIG. 2 is a view for explaining a horizontal line stripe phenomenon in the liquid crystal display panel shown in FIG. 1. As shown in FIG. 2, the LOG-type signal line group 26 supplying the gate control signals (i.e., GSP, GSC and GOE) and power signals (VGH, VGL, VCC, GND and VCOM) is comprised of first to third LOG-type signal line groups LOG1 to LOG3 between the gate TCPs 8. The first to third LOG-type signal line groups LOG1 to LOG3 have line resistances aΩ, bΩ and cΩ proportional to the line length thereof, respectively, and are connected, via the gate TCP 8 and the gate drive IC 10, to each other in series. The first to third LOG-type signal line groups LOG1 to LOG3 generate a level difference between the gate control signals (i.e., GSP, GSC and GOE) and power signals (VGH, VGL, VCC, GND and VCOM) input for each gate drive IC 10. As a result, a brightness difference is generated between horizontal line blocks A to C that are driven by different gate drive IC's and thereby cause the appearance of a horizontal line stripe 32.

The first gate drive IC 10 is supplied with gate control signals GSP, GSC and GOE and power signals VGH, VGL, VCC, GND and VCOM across a line resistance aΩ of the first LOG-type signal line group LOG1; the second gate drive IC 10 is supplied with such gate control signals across line resistances aΩ+bΩ of the first LOG-type signal line group LOG1 and the second LOG-type signal line group LOG2; and the third gate drive IC 10 is supplied with gate control signals across line resistances aΩ+bΩ+cΩ of the first to third LOG-type signal line groups LOG1 to LOG3. Thus, a different voltage drop is generated among scanning pulses VG1 to VG3 applied to the gate lines at the first to third horizontal blocks A to C driven by different gate drive IC's 10, thereby causing horizontal line stripes 32 among the horizontal line blocks A to C.

SUMMARY OF THE INVENTION

Accordingly, the present invention is directed to a liquid crystal display and a driving method thereof that substantially obviates one or more of the problems due to limitations and disadvantages of the related art.

An object of the present invention to provide a liquid crystal display and a driving method thereof for preventing a deterioration of picture quality due to signal distortion.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display includes: a liquid crystal display panel having liquid crystal cells arranged in a matrix defined by data lines and gate lines that cross each other, wherein a thin film transistor is provided in each respective cell adjacent to a crossing of a data line and a gate line for the respective cell; a scanning voltage generator to generate at least two scanning voltages that have different values; a plurality of gate driving integrated circuits to generate scanning pulses using the scanning voltages and to supply the scanning pulse to the gate lines; and a switching circuit to switch the scanning voltages and to apply the scanning voltages to the gate driving integrated circuits.

In another aspect, a method of driving a liquid crystal display having liquid crystal cells arranged in a matrix defined by data lines and gate lines that cross each other and a thin film transistor is provided in each respective cell adjacent to a crossing of a data line and a gate line for a respective cell, includes the steps of: generating at least two scanning voltages having a different voltage from each other; switching the scanning voltages to generate scanning pulses that have different voltages; and scanning a liquid crystal display panel using the scanning pulse.

In yet another aspect, a liquid crystal display includes: a liquid crystal display panel having liquid crystal cells arranged in a matrix defined by data lines and gate lines that cross each other, wherein a thin film transistor is provided in each respective cell adjacent to a crossing of a data line and a gate line for the respective cell; a means for generating at least two scanning voltages that have different values; a means for generating scanning pulses using the scanning voltages and to supply the scanning pulse to the gate lines; and a means for switching the scanning voltages and to apply the scanning voltages to the gate driving integrated circuits.

It is to be understood that both the foregoing general description and the following detailed description are exemplary and explanatory and are intended to provide further explanation of the invention as claimed.

BRIEF DESCRIPTION OF THE DRAWINGS

These and other objects of the invention will be apparent from the following detailed description of the embodiments of the present invention with reference to the accompanying drawings.

DETAILED DESCRIPTION OF THE PREFERRED EMBODIMENTS

Reference will now be made in detail to the preferred embodiments of the present invention, examples of which are illustrated in the accompanying drawings.

Figure 3:
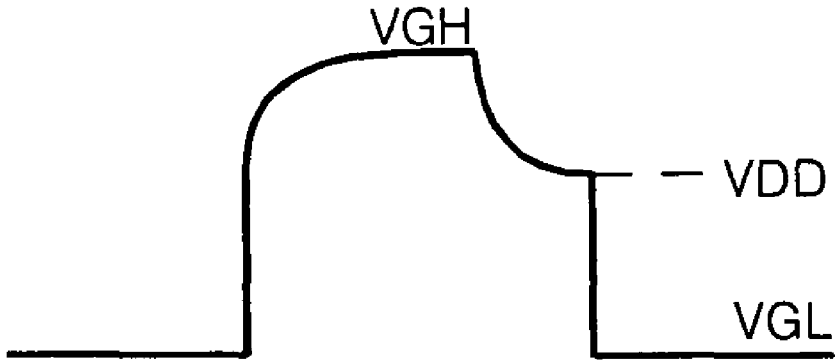
FIG. 3 RELATED ART
FIG. 3 illustrates a scanning pulse used to reduce an occurrence of flicker.

FIG. 3 illustrates a scanning pulse used to reduce an occurrence of flicker. As shown in FIG. 3, a scanning pulse applied to gate lines of an LOG-type liquid crystal display according to an embodiment of the present invention to reduce an occurrence of flicker. Flicker is caused as a feed through voltage ΔVp rises. Such a through feed voltage ΔVp is more when the scanning pulse falls.

To reduce the occurrence of flicker, a reduction of the feed through voltage ΔVp is required when the scanning pulse falls. Such a reduction of the feed through voltage ΔVp is achieved by a reduction in voltage difference ΔVg, which is between a gate high voltage VGH and a gate low voltage VGL of the scanning pulse, as can be seen from the following equation (1).

$$\Delta Vp = \frac{Cgd}{Cgd + Clc + Cst}\Delta Vg\Lambda\Lambda\Lambda\Lambda \quad (1)$$

Cgd represents a parasitic capacitor formed between a gate terminal and a drain terminal of a TFT. Clc represents a liquid crystal capacitor connected between the drain terminal and a common electrode of the TFT. Cst represents a storage capacitor connected to the drain terminal of the TFT and a pre-stage gate line. The voltage difference ΔVg represents a difference voltage between a gate high voltage VGH and a gate low voltage VGL of a gate pulse.

Figure 1:
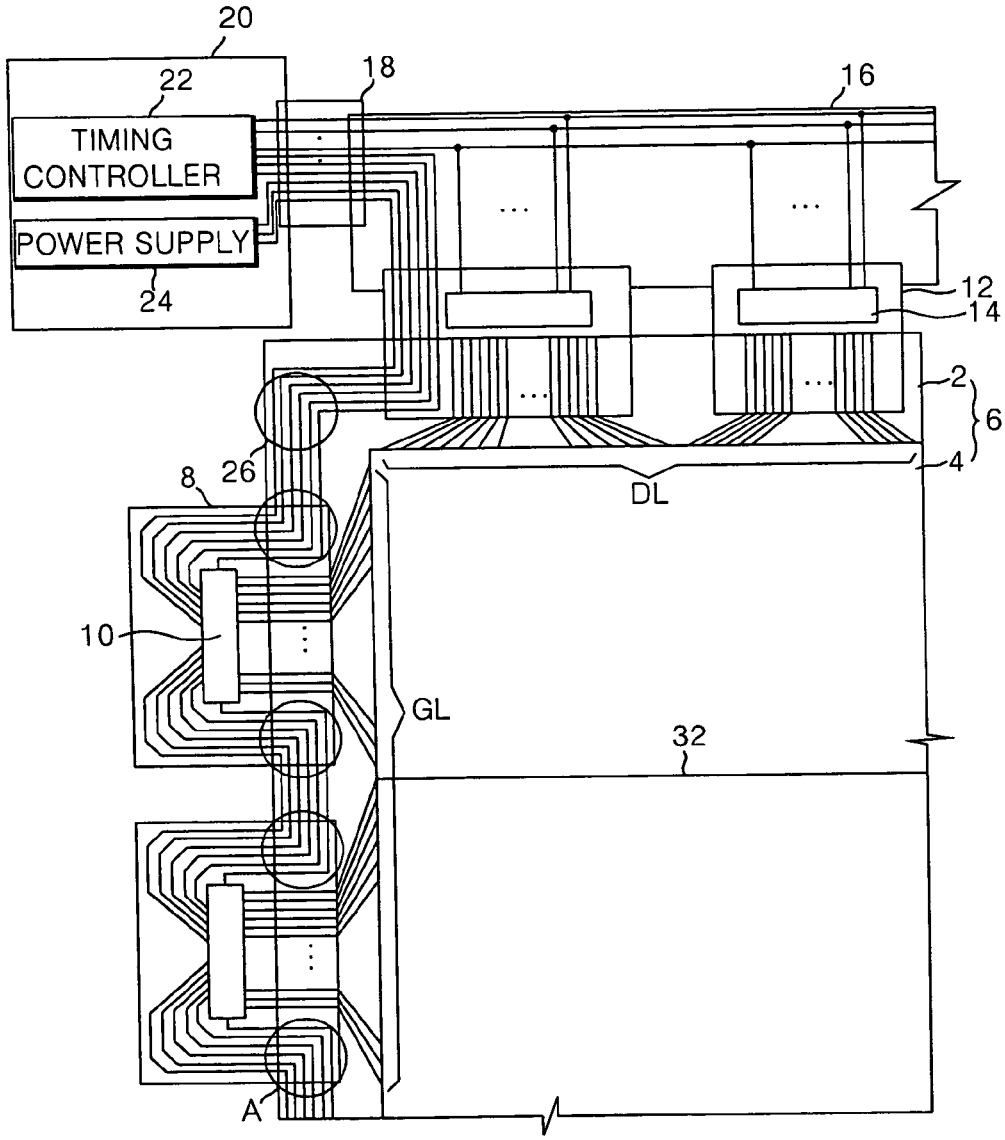
FIG. 1 RELATED ART
FIG. 1 is a schematic plan view showing a configuration of a conventional line on glass (LOG) type liquid crystal display.
Figure 2:
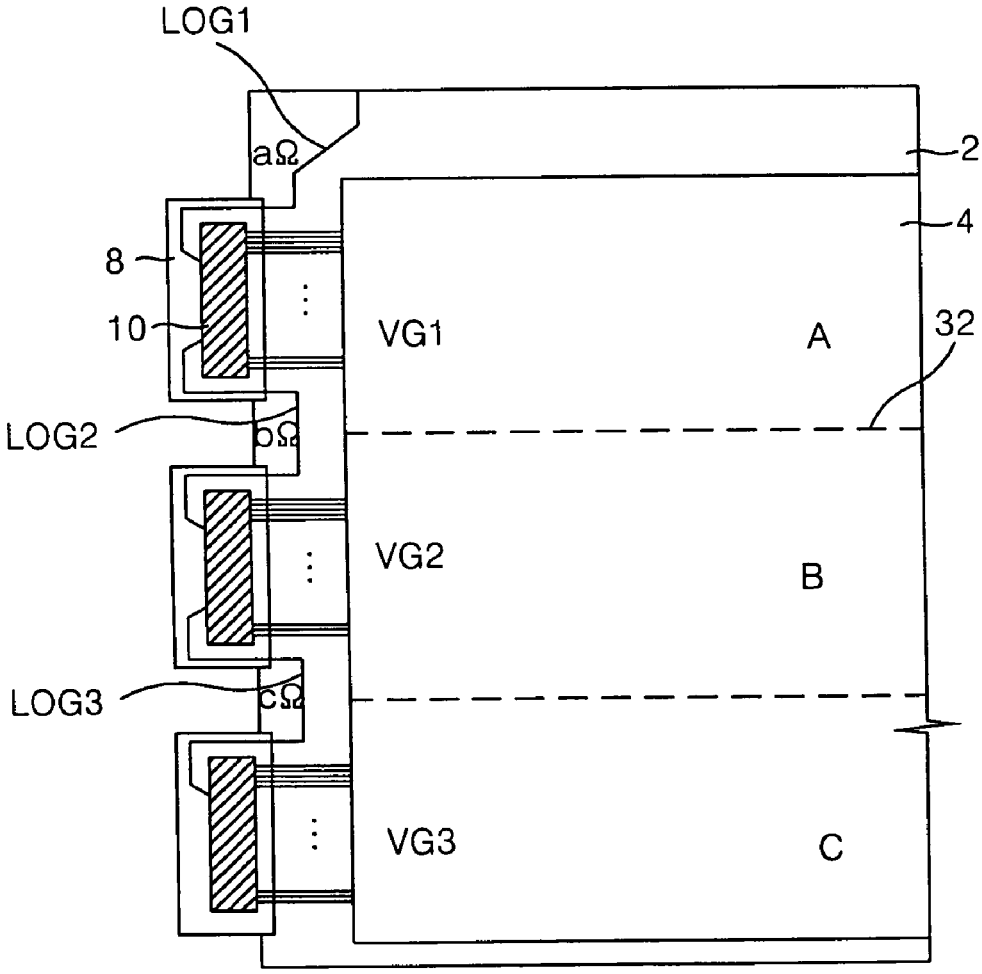
FIG. 2 RELATED ART
FIG. 2 is a view for explaining a horizontal line stripe phenomenon in the liquid crystal display panel shown in FIG. 1.

The feed through voltage ΔVp can be reduced by dropping the gate high voltage VGH to a VDD voltage and thereafter dropping it into the gate low voltage VGL as shown in FIG. 3, thereby lowering the feed through voltage ΔVp as can be seen from the above equation (1). Herein, ΔVg, which is a difference voltage between the gate high voltage VGH and the gate low voltage VGL, becomes a voltage subtracting the gate low voltage VGL from the VDD voltage when the scanning pulse falls. Accordingly, the occurrence of flicker is reduced. However, a problem occurs when the scanning pulse shown in FIG. 3 is applied to the conventional LOG-type liquid crystal display shown in FIG. 1. This problem will be described with reference to FIG. 4A to FIG. 4C below.

Figure 4A:
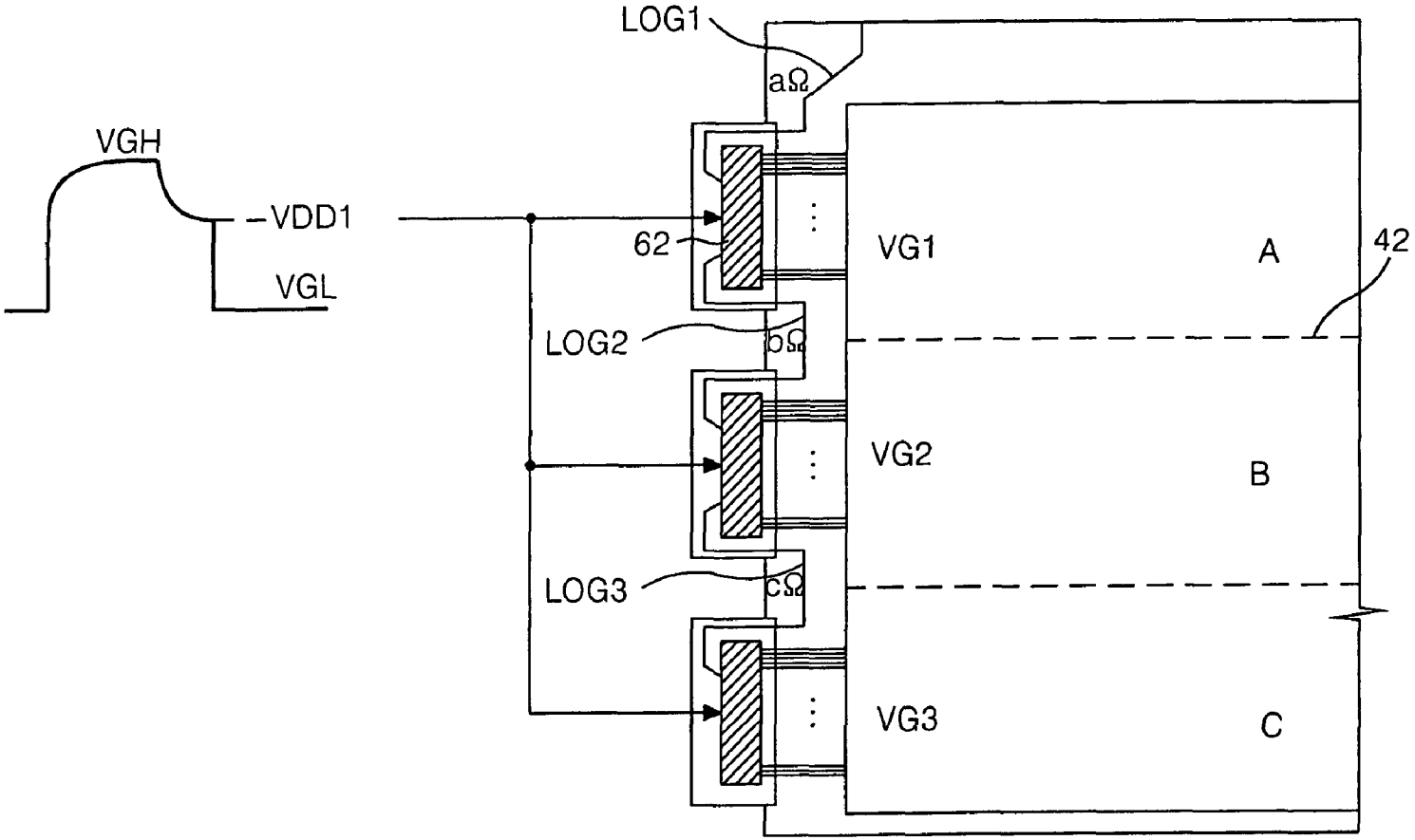
FIG. 4A RELATED ART
FIG. 4A to FIG. 4C illustrate a process in which the scanning pulse shown in FIG. 3 is applied, via the LOG-type signal line, to the gate drive integrated circuits.
Figure 4B:
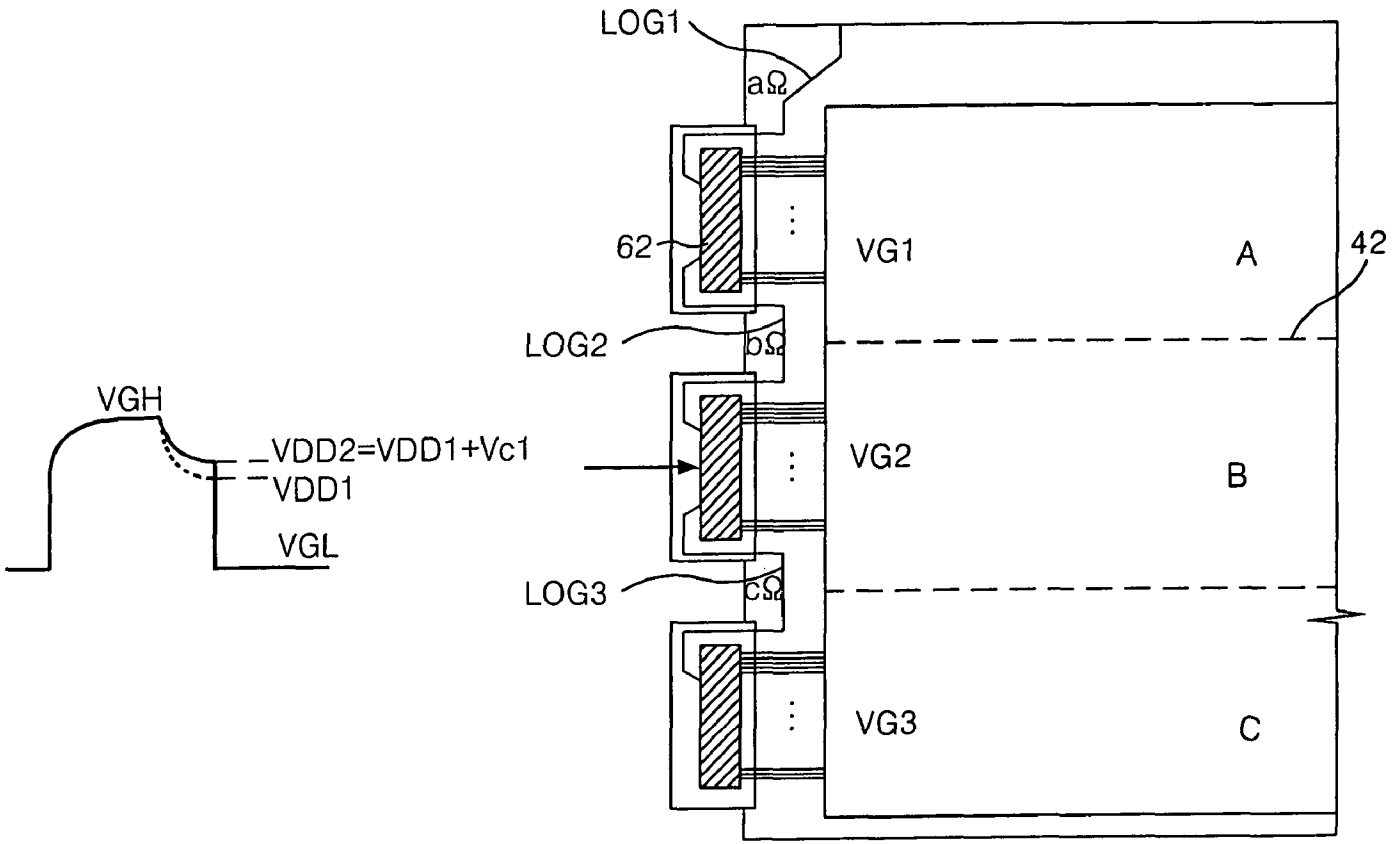
FIG. 4B RELATED ART
Figure 4C:
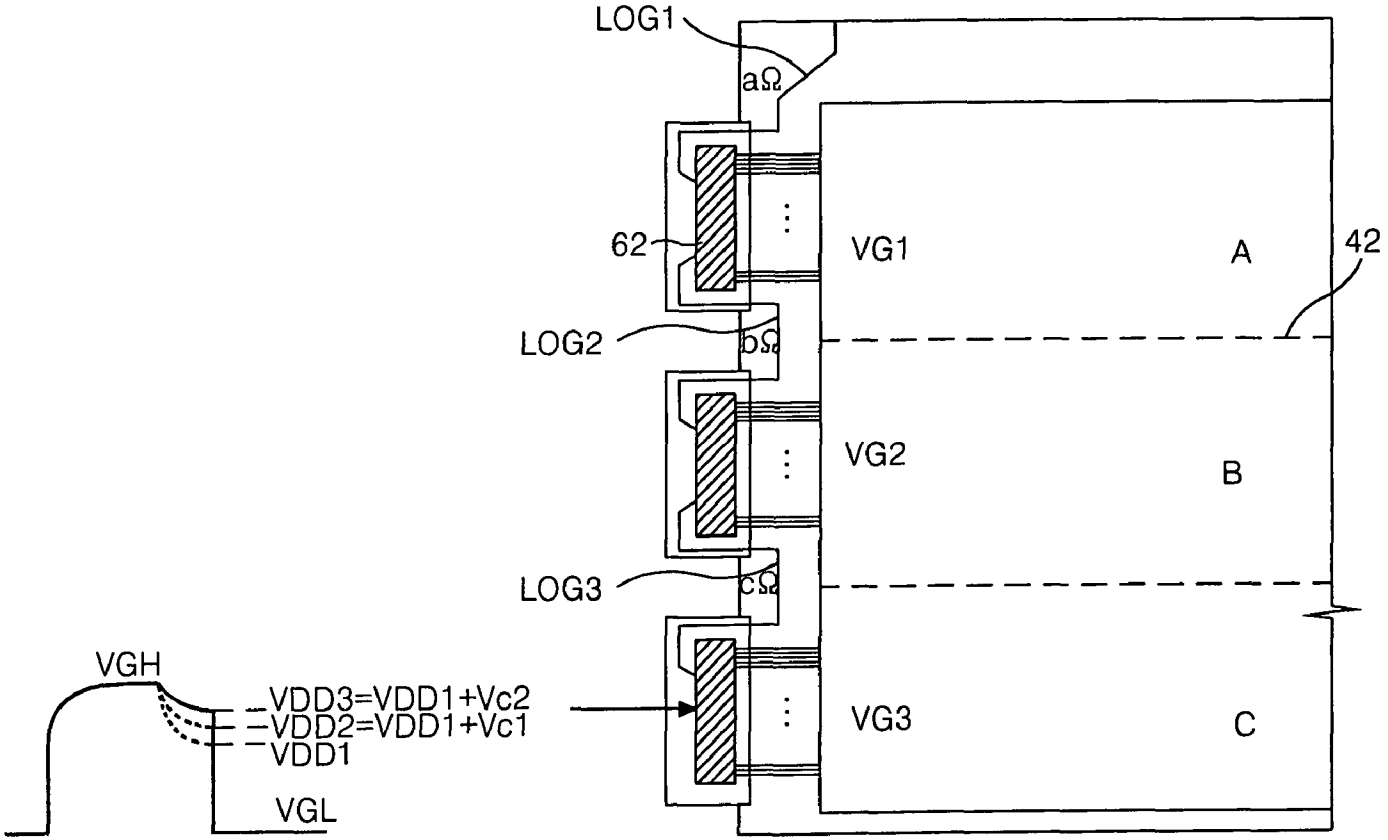
FIG. 4C RELATED ART

FIG. 4A to FIG. 4C illustrate a process in which the scanning pulse shown in FIG. 3 is applied, via the LOG-type signal line, to the gate drive integrated circuits. To reduce the occurrence of flicker, a scanning pulse in which the gate high voltage VGH falls to a first VDD voltage VDD1, as shown in FIG. 4A, is sequentially applied to a plurality of gate lines connected with gate drive IC's 62. However, such a scanning pulse has a decreased voltage drop due to partial signal loss caused by the first resistances aΩ and second line resistance bΩ of the first and second LOG-type signal line groups LOG1 and LOG2 when the scanning pulse is applied to the gate lines in the second horizontal block B connected to the second gate drive IC 62. Thus, the gate lines connected with the second gate drive IC 62 are supplied with a scanning pulse in which the gate high voltage VGH falls to a second VDD voltage VDD2 (i.e., VDD2=VDD1+Vc1) that is higher, by a first direct current voltage Vc1, than the first VDD voltage VDD1, as shown in FIG. 4B. In other words, although the gate high voltage VGH should to fall to the first VDD voltage VDD1, the gate high voltage VGH only falls only to a second VDD voltage VDD2 due to the partial signal loss caused by the first line resistance aΩ and second line resistance bΩ of the first and second LOG-type signal line groups LOG1 and LOG2. Further, when the scanning pulse is applied to the gate lines in the third horizontal block C connected with the third gate drive IC 62, a larger signal loss occurs due to the first to third line resistances aΩ to cΩ of the first to third LOG-type signal line groups LOG1 to LOG3. Thus, the gate lines connected with the third gate drive IC 62 are supplied with a scanning pulse in which the gate high voltage VGH falls to a third VDD voltage (i.e., VDD3=VDD1+Vc2) that is higher, by the second direct current voltage Vc2, than the first VDD voltage VDD1, as shown in FIG. 4C. In other words, although the gate high voltage VGH should fall to the first VDD voltage VDD1, the gate high voltage VGH only falls to the third VDD voltage VDD3 that is higher than the second VDD voltage VDD2 due to signal loss caused by the first to third line resistances aΩ+bΩ+cΩ of the first to third LOG-type signal line groups LOG1 to LOG3. Thus, the problem is that a difference occurs among gate signals VG1 to VG3 applied to the gate lines at the first to third horizontal blocks A to C driven by different gate drive IC's 62 horizontal line stripes 42 that causes a deterioration of picture quality.

Figure 5:
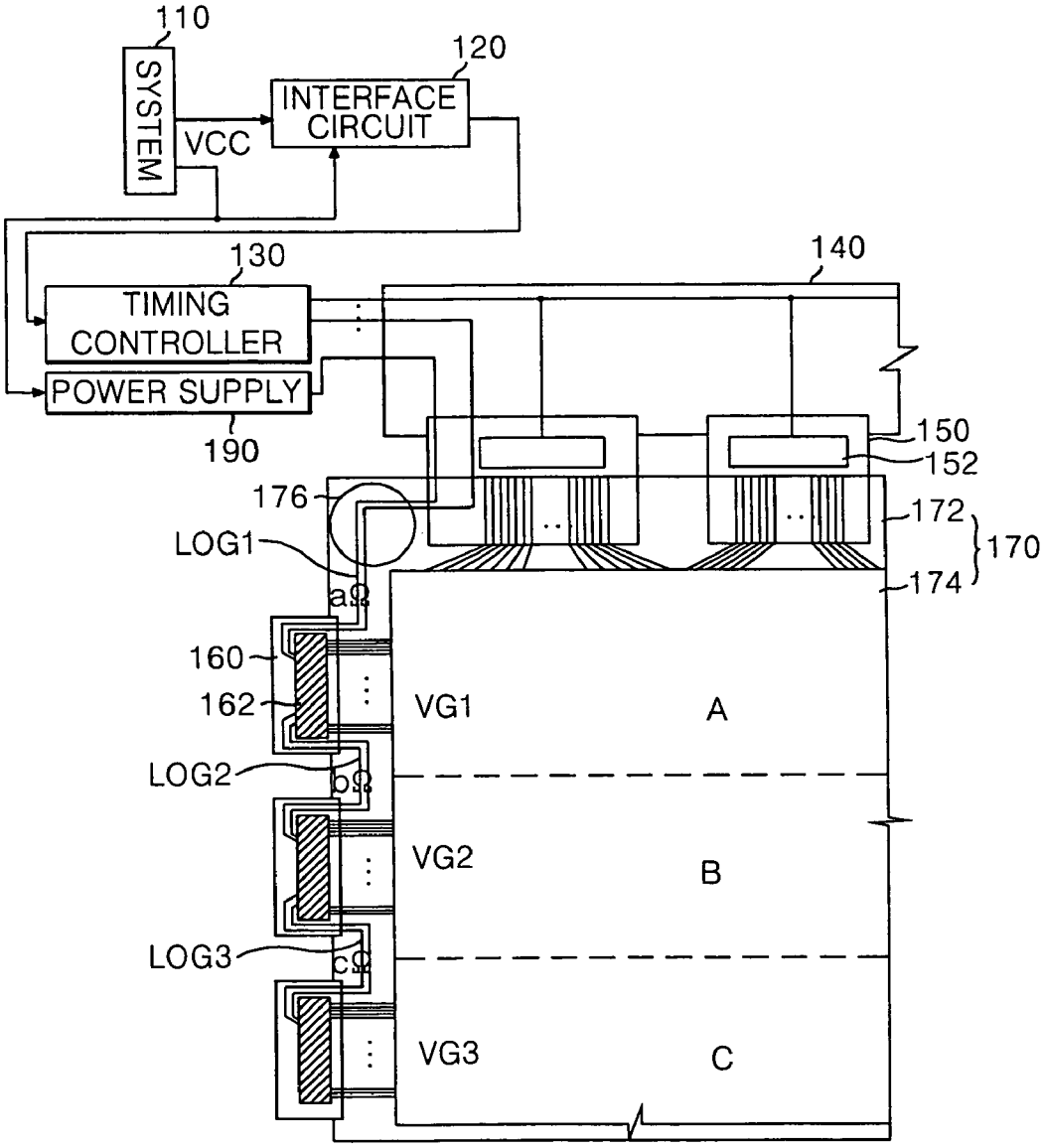
FIG. 5 is a schematic plan view showing a configuration of a LOG-type liquid crystal display according to an embodiment of the present invention.
Figure 6:
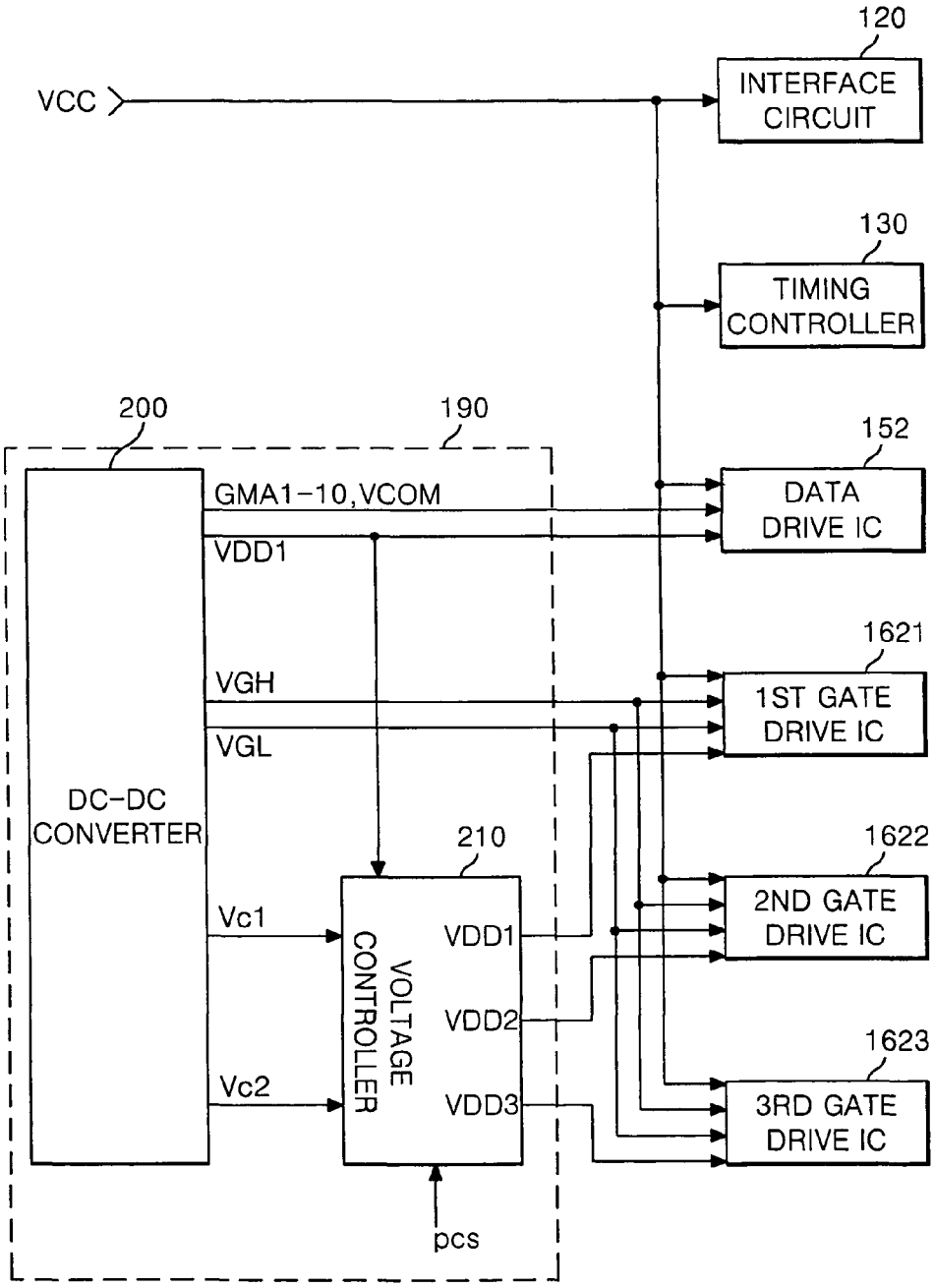
FIG. 6 is a detailed block diagram of the power supply shown in FIG. 5.

FIG. 5 and FIG. 6 show an LOG-type liquid crystal display according to an embodiment of the present invention. Referring to FIG. 5 and FIG. 6, the LOG-type liquid crystal display according to the embodiment of the present invention includes a liquid crystal display panel 170 for receiving various signals from a system 110, a plurality of data TCP's 150 having data integrated circuits (IC's) 152 for supplying data to data lines of the liquid crystal display panel 170, a plurality of gate TCP's 160 having gate drive IC's 162 for supplying a scanning signal to gate lines thereof, a timing controller 130 for controlling the plurality of data TCP's 150 and the plurality of gate TCP's 160 using a synchronizing signal from an interface circuit 120, and a power supply 190 for generating voltages supplied to the liquid crystal display panel 170. The system 110 applies vertical/horizontal synchronizing signals, a clock signal and a data, via a low voltage differential signaling (LVDS) transmitter of a graphic controller, to the interface circuit 120, and applies a VCC voltage of 3.3V generated from a power source to digital circuit devices 120, 130, 152 and 162 and the power supply 190 as a supply voltage.

In the liquid crystal display panel 170, a thin film transistor array substrate 172 and a color filter array substrate 174 are joined to each other with a liquid crystal therebetween. Such a liquid crystal display panel 170 is provided with liquid crystal cells that are each driven independently by a thin film transistor adjacent to a crossing of a gate line and data line. The thin film transistor applies a pixel signal from the data line to a liquid crystal cell in response to a scanning signal from the gate line. Meanwhile, the gate control signals and the power signals from the timing controller 130 and the power supply 190 are applied, via the data PCB 140, to the data TCP 150. The gate control signals and the power signals applied via the data TCP 150 are applied, via a LOG-type signal line group 176 provided in the edge area of the thin film transistor array substrate 172, to the gate TCP 160. The gate control signals and the power signals applied to the gate TCP 160 are input, via input terminals of the gate drive IC 162. Further, the gate control signals and the power signals are output via output terminals of the gate drive IC 162, and applied, via the gate TCP 160 and the LOG-type signal line 176, to the gate drive IC 1162 mounted in the next gate TCP 160. Herein, for the convenience of explanation, the present embodiment has three gate drive IC's 162. However, fewer or more gate drive IC's can be used. The LOG-type signal line group 176 includes signal lines for supplying direct current driving voltages from the power supply 190, such as a gate low voltage VGL, a gate high voltage VGH, a common voltage VCOM, a ground voltage GND and a base driving voltage VCC; and gate control signals from the timing controller 130, such as a gate start pulse GSP, a gate shift clock signal GSC and a gate enable signal GOE.

The data drive IC 152 is connected, via the data TCP 150 and a data pad of the liquid crystal display panel 170, to the data line. The data drive IC 152 converts a pixel data into an analog pixel signal to apply it to the data line. The data drive IC 152 receives a data control signal, a pixel data and power signals from the timing controller 130 and the power supply 190 by way of the data PCB 140.

The gate drive IC 162 is connected, via the gate TCP 160 and a gate pad of the liquid crystal display panel 170, to the gate lines. The gate drive IC 162 sequentially applies a scanning signal having a gate high voltage VGH to the gate lines. Further, the gate drive IC 162 applies a gate low voltage VGL to the gate lines in the remaining interval excluding a time interval when the gate high voltage VGH has been supplied. The gate drive IC 162 is supplied with a VCC voltage of 3.3V, for example, as a supply voltage.

The timing controller 130 generates gate control signals for controlling the gate drive IC's 162 and data control signals for controlling the data drive IC's 152 using vertical/horizontal synchronizing signals and a clock signal input, via the interface circuit 120, from a graphic controller of the system 110. Further, the timing controller 130 re-aligns a digital video data input, via the interface circuit 120, from the graphic controller of the system 110, and applies the digital video data to the plurality of data drive IC's 152. A supply voltage for driving the timing controller 130 is a VCC voltage of 3.3V, for example, input from a power source of the system 110.

The interface circuit 120 includes a low voltage differential signaling (LVDS) receiver to lower voltage levels of signals input from the graphic controller of the system 110 and raises frequencies thereof, thereby reducing the number of signal wirings required between the system 110 and the timing controller 130. A supply voltage for driving the interface circuit 120 is a VCC voltage of 3.3V, for example, input from a power source of the system 110. The power supply 190 receives the VCC voltage of 3.3V, for example, input from the power source of the system 110 by way of a connector (not shown) thereby generating a driving voltage for driving the liquid crystal display panel 170. As shown in FIG. 6, the power supply 190 includes a DC-DC converter 200 for generating voltages supplied to the plurality of gate drive IC's 1621 to 1623 and the plurality of data drive IC's 152, and a voltage controller 210 for controlling a first middle voltage VDD1 supplied from the DC-DC converter 200.

The DC-DC converter 200 raises or drops the VCC voltage of 3.3V, for example, from the power source of the system 110 to generate a voltage supplied to the liquid crystal display panel 170. The DC-DC converter 200 also includes an output switching device for switching an output voltage to the output terminal thereof, and a pulse width modulator (PWM) or a pulse frequency modulator (PFM) for controlling a duty ratio or a frequency of a control signal from the output switching device to raise or drop the output voltage. The pulse width modulator raises a duty ratio of the control signal from the output switching device to increase output voltages of the DC-DC converter 200, or lowers a duty ratio of the control signal from the output switching device to decrease an output voltage of the DC-DC converter 200. The pulse frequency modulator raises a frequency of the control signal from the output switching device to increase output voltages of the DC-DC converter 200, or lowers a frequency of the control signal from the output switching device to decrease an output voltage of the DC-DC converter 200. The output voltages of the DC-DC converter 200 includes a first middle voltage VDD1 of 6V or more, gamma reference voltages GMA1~10 of less than 10 steps, a VCOM voltage of 2.5~3.3V, a VGH voltage having 15V or more and a VGL voltage having −4V or less. Further, the DC-DC converter 200 outputs the first current voltage Vc1 and the second direct current voltage Vc2. Herein, the first direct current voltage Vc1 is a voltage distorted by a line resistance of a line on glass (LOG) type signal line provided between the first gate drive IC 1621 and the second gate drive IC 1622. The second direct current voltage Vc2 is a voltage distorted by a line resistance of a LOG-type signal line provided between the second gate drive IC 1622 and the third gate drive IC 1623. The first current voltage Vc1 and the second direct current voltage Vc2 are set in advance.

The gamma reference voltages GMA1~10 are voltages generated by a voltage division of the first middle voltage VDD1. The first middle voltage VDD1 and the gamma reference voltages are analog gamma voltages applied to the data drive IC's 152. The VCOM voltage is a voltage supplied, via the data drive IC's 152, to the common electrode provided on the liquid crystal display panel 170. The VGH voltage is a high logical voltage of a scanning pulse set to more than a threshold voltage of the TFT and which is applied to the first to third gate drive IC's 1621 to 1623. On the other hand, the VGL voltage is a low logical voltage of a scanning pulse set to an off voltage of the TFT and which is applied to the first to third gate drive IC's 1621 to 1623.

Figure 7:
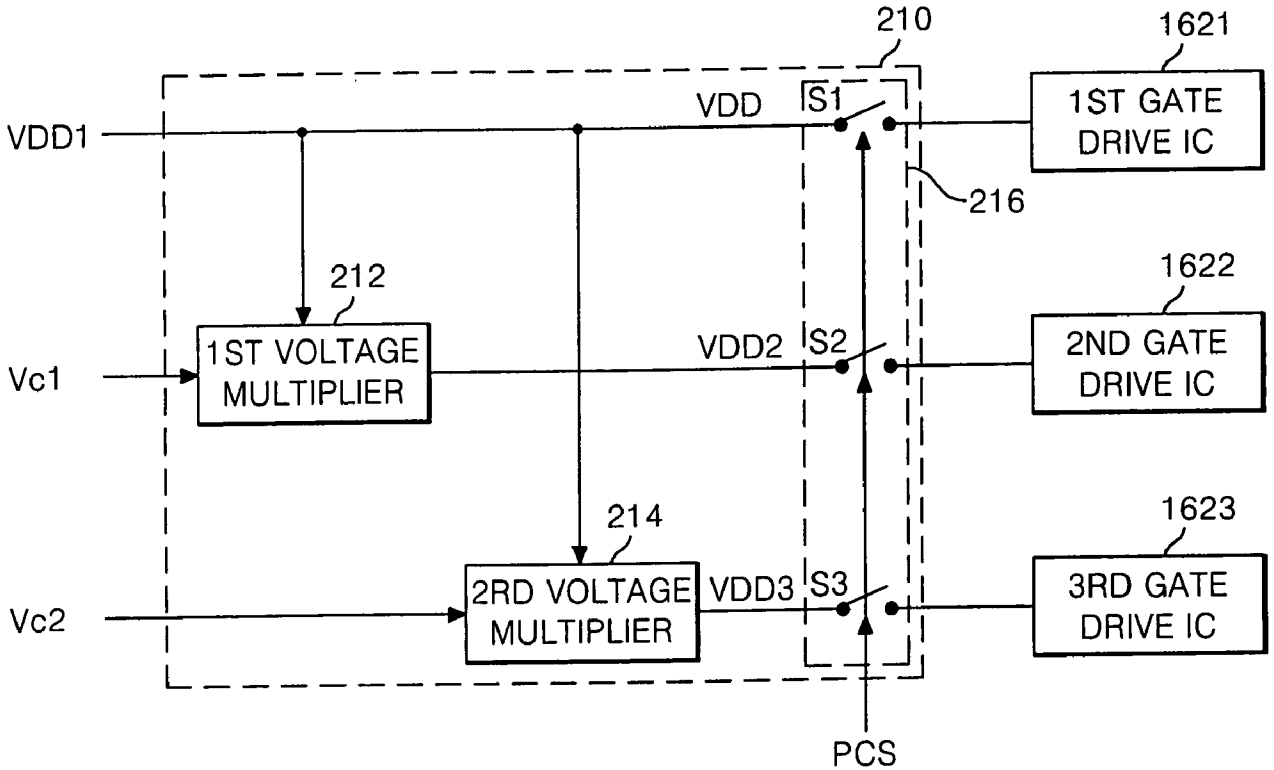
FIG. 7 is a detailed block diagram of the voltage controller shown in FIG. 6.

FIG. 7 is a detailed block diagram of the voltage controller shown in FIG. 6. The voltage controller 210 controls the first middle voltage VDD1 from the DC-DC converter 200 and applies it to the plurality of gate drive IC's 1621 to 1623 for the purpose of preventing the occurrence of flicker and a deterioration of picture quality. As shown in FIG. 7, the voltage controller 210 includes a first voltage multiplier 212 for outputting a second middle voltage VDD2 obtained by summing the first middle voltage VDD1 with the first direct current voltage Vc1 input from the DC-DC converter 200, a second voltage multiplier 214 for outputting a third middle voltage VDD3 obtained by summing the first middle voltage VDD1 with the second direct current voltage Vc2 input from the DC-DC converter 200, and a voltage selector 216 for receiving the first middle voltage VDD1 input from the DC-DC converter 200, the second middle voltage VDD2 input from the first voltage multiplier 212 and the third middle voltage VDD3 input from the second voltage multiplier 214 to selectively output them.

Figure 8:
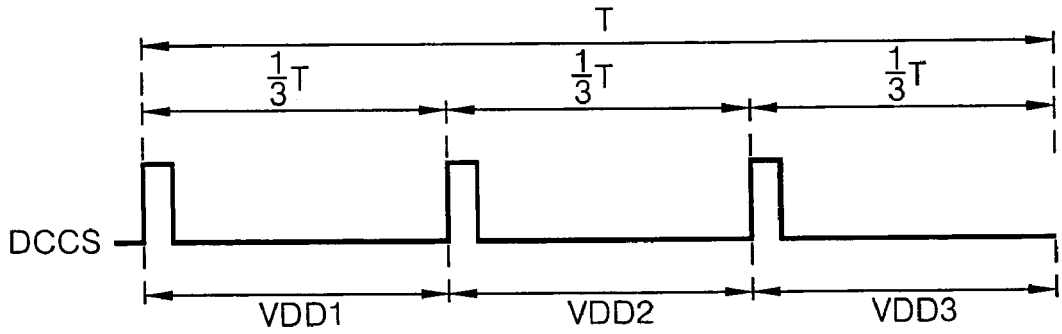
FIG. 8 is a waveform diagram of a period control signal (PCS) applied to the voltage controller shown in FIG. 6.

The LOG-type liquid crystal display according to the embodiment of the present invention has three gate drive IC's 1621 to 1623, the voltage selector 216 applies a pulse to a period control signal PCS every ⅓ period, as shown in FIG. 8, to thereby determine an output sequence of the first to third middle voltages VDD1 to VDD3. Herein, one period of the period control signal PCS is total scanning time of the gate lines provided on the liquid crystal display panel 170. The voltage selector 216 receives the period control signal PCS to turn on a first switch S1 during an initial ⅓ period (1T/3) of the period control signal PCS. At this time, second switch S2 and third switch S3 are in an off state. Thus, during the initial ⅓ period (1T/3) of the period control signal PCS, the first middle voltage VDD1 is applied to the first gate drive IC 1621. The voltage selector 216 turns on the second switch S2 during the next ⅓ period (1T/3) of the period control signal PCS. At this time, the first switch S1 and the third switch S3 are in an off state. Thus, during the next ⅓ period (1T/3) of the period control signal PCS, the second middle voltage VDD2 is applied to the second gate drive IC 1622. Further, the voltage selector 216 turns on the third switch S3 during the remaining ⅓ period (1T/3) of the period control signal PCS. At this time, the first and second switches S1 and S2 are in an off state. During the remaining ⅓ period (1T/3) of the period control signal PCS, the third middle voltage VDD3 is applied to the third gate drive IC 1623.

Figure 9:
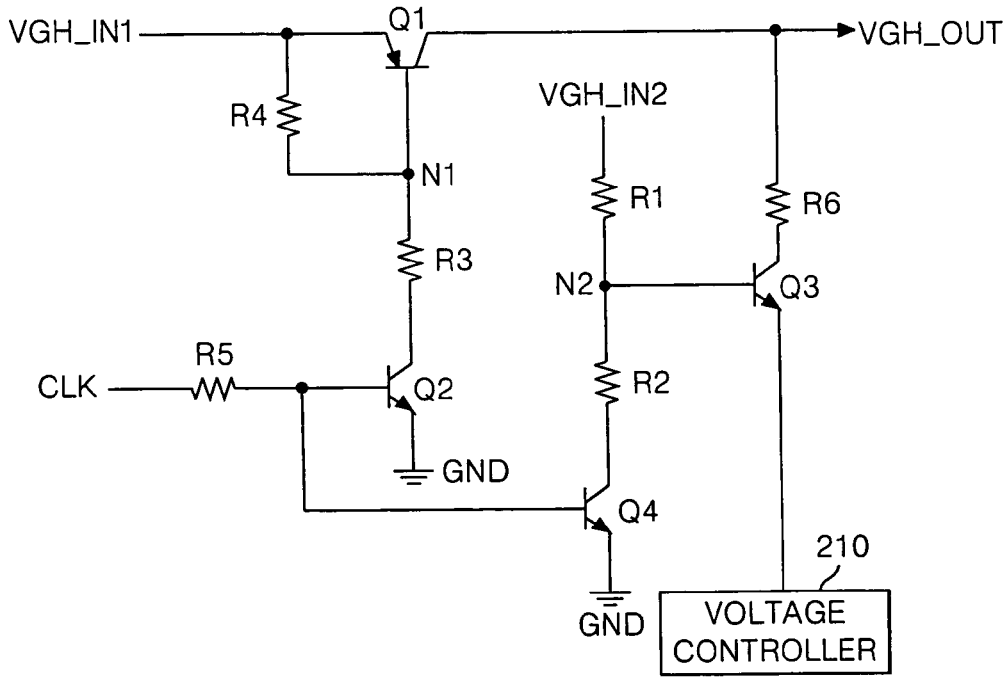
FIG. 9 is a circuit diagram of a scanning pulse generator built in the gate drive integrated circuits shown in FIG. 5.

FIG. 9 is a circuit diagram of a scanning pulse generator built in the gate drive integrated circuits shown in FIG. 5. As shown in FIG. 9, a scanning pulse generator is built in each of the first to third gate drive IC's 1621 to 1623. The scanning pulse generator generates a scanning pulse, as shown in FIG. 3, and sequentially applies it to the gate lines.

The scanning pulse generator includes a first p-type transistor Q1 connected between a first gate high voltage input line VGH_IN1 and a gate high voltage output line VGH_OUT, a second n-type transistor Q2 provided between the first p-type transistor Q1 and a ground terminal GND, a third n-type transistor Q3 provided between the gate high voltage output line VGH_OUT and the voltage controller 210, and a fourth n-type transistor Q4 provided between the third n-type transistor Q3 and the ground terminal GND.

The first p-type transistor Q1 delivers a gate high voltage VGH from the first gate high voltage input line VGH_IN1 into the gate high voltage output line VGH_OUT. Such a first p-type transistor Q1 is operated in accordance with a threshold voltage of the base terminal thereof. The threshold voltage is determined by a third resistor R3 provided between the base terminal of the first p-type transistor Q1 and the second n-type transistor Q2 and a fourth resistor R4 provided between the first gate high voltage input line VGH_IN1 and the third resistor R3. A voltage emerging at a first node N1 between the third resistor R3 and the fourth resistor R4 is determined by an operation of the second n-type transistor Q2.

The second n-type transistor Q2 is operated in response to a clock signal from a clock signal input line CLK input to the base terminal thereof. The second n-type transistor Q2 has a threshold voltage determined by a bias voltage of a fifth resistor R5 connected between the base terminal thereof and the clock signal input line CLK.

The third n-type transistor Q discharges a gate high voltage VGH on the gate high voltage output line VGH_OUT. The gate high voltage VGH is discharged into a voltage supplied from the voltage controller 210 via a pull-up resistor R6 provided between the gate high voltage output line VGH_OUT and the third n-type transistor Q3. Such a third n-type transistor Q3 is operated in accordance with a threshold voltage of the base terminal thereof. The first resistor R1 and second resistor R2 are connected to each other and to the base terminal of the third n-type transistor Q3, that is, a second node N2. The first resistor R1 and the second resistor R2 are voltage-dividing resistors. The first resistor R1 is connected to the second gate high voltage input line VGH_IN2 and the second resistor R2 is connected to the fourth n-type transistor Q4. Resistance values of the first resistor R1 and the second resistor R2 lower a threshold voltage of the third n-type transistor Q3 when the fourth n-type transistor Q4 is turned on while increasing the threshold voltage of the third n-type transistor Q3 when the fourth n-type transistor Q4 is turned off. The fourth n-type transistor Q4 is connected to the clock signal input line CLK.

A scanning pulse generator allows the gate high voltage VGH to be delivered, via the second n-type transistor Q2 and the first p-type transistor Q1, into the gate high voltage output line VGH_OUT when a high state of clock signal is input from the clock signal input line CLK. More specifically, a voltage at the first node N1 is discharged into the ground terminal GND through the third resistor R3 and the second n-type transistor Q2, so that the first p-type transistor Q1 is turned on. At this time, since the fourth n-type transistor Q4 is turned on simultaneously with the second n-type transistor Q2, the third n-type transistor Q3 goes into a turn-off state. Since a voltage at the second node N2 has a lower level than a voltage supplied from the voltage controller 210 by a voltage division of the first resistor R1 and the second resistor R2 as the fourth n-type transistor Q4 is turned on, the third n-type transistor Q3 goes into a turn-off state.

As described above, the gate high voltage VGH generated from the scanning pulse generator is applied, via the first p-type transistor Q1 and the gate high voltage output line VGH_OUT, to the gate lines. The scanning signal having the gate high voltage VGH turns on the TFT, and the pixel cell charges from a data signal supplied via the data drive IC 152 during a time interval when the TFT is turned on. On the other hand, if a low state of clock signal is input from the clock signal input line CLK, then the gate high voltage VGH is shut off by the first p-type transistor Q1. More specifically, as the second n-type transistor Q2 is turned off by the clock signal, the first p-type transistor Q1 has a threshold voltage raised due to the gate high voltage VGH emerging at the first node N1 by a resistance value of the fourth resistor R4 to thereby be turned off.

When the fourth n-type transistor Q4 is turned off simultaneously with the second n-type transistor Q2, the third n-type transistor Q3 goes into a turn-on state. Since a voltage at the second node N2 becomes higher than a voltage level supplied from the voltage controller 210 by a voltage division of the first resistor R1 and the second resistor R2 as the fourth n-type transistor Q4 is turned off, the third n-type transistor Q3 is turned on to thereby discharge a gate high voltage VGH at the gate high voltage output line VGH_OUT, via a pull-up resistor R6 and the third n-type transistor Q3, into a voltage supplied from the voltage controller 210. Thus, the gate high output voltage VGH_OUT drops until a voltage supplied from the voltage controller 210 and thereafter drops into the gate low voltage VGL. Accordingly, a scanning pulse as shown in FIG. 3 is generated to be sequentially applied to the gate lines. Meanwhile, each of the gate drive IC's 1621 to 1623 receives a gate high voltage VGH from the DC-DC converter 200 and selectively receives the first to third middle voltages VDD1 to VDD3 from the voltage controller 210 in response to the period control signal PCS, thereby applying a modified gate high voltage VGH to the first to third gate drive IC's 1621 to 1623.

Figure 10A:
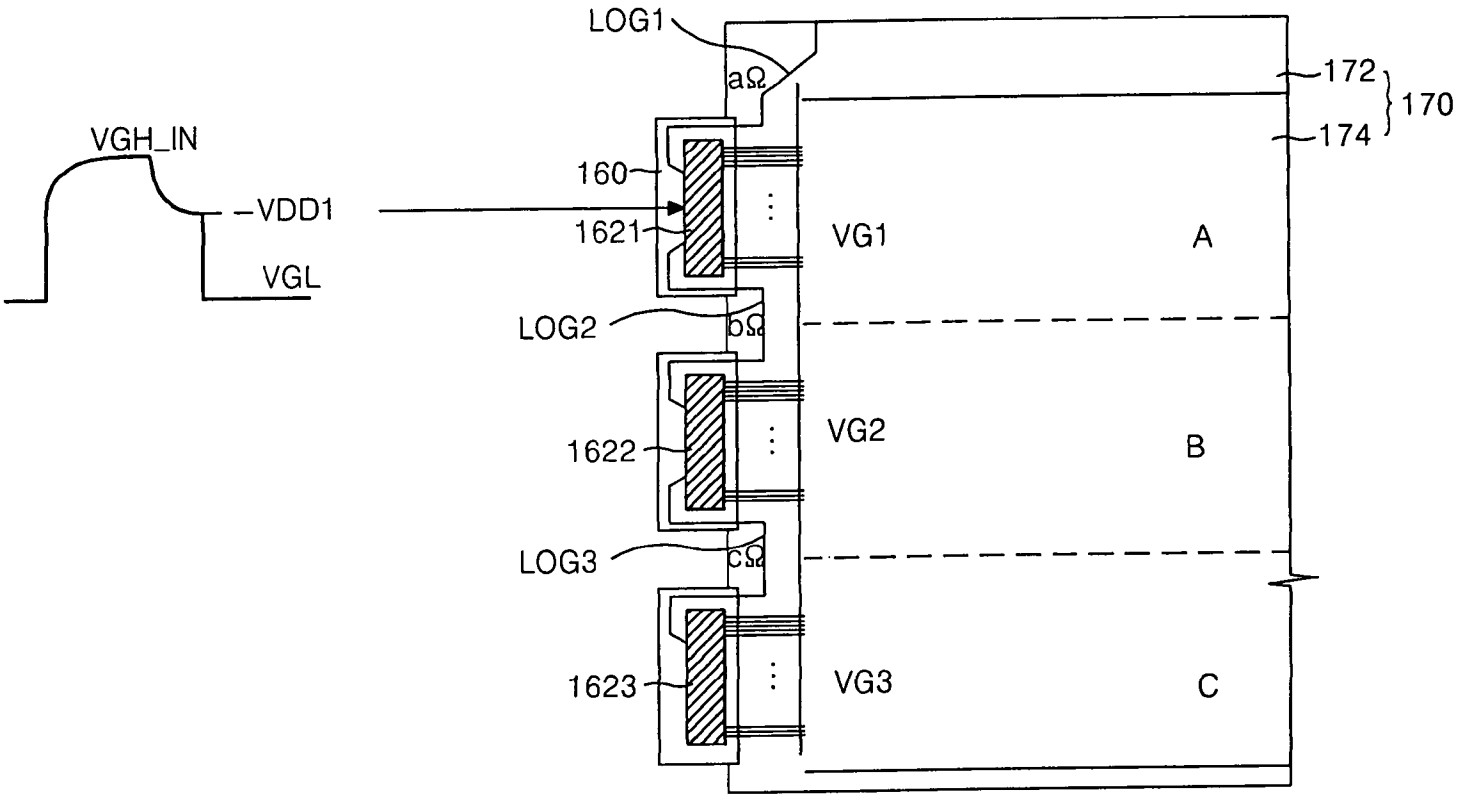
FIG. 10A to FIG. 10C illustrate a process in which the same scanning voltage is applied to the gate drive integrated circuits.
Figure 10B:
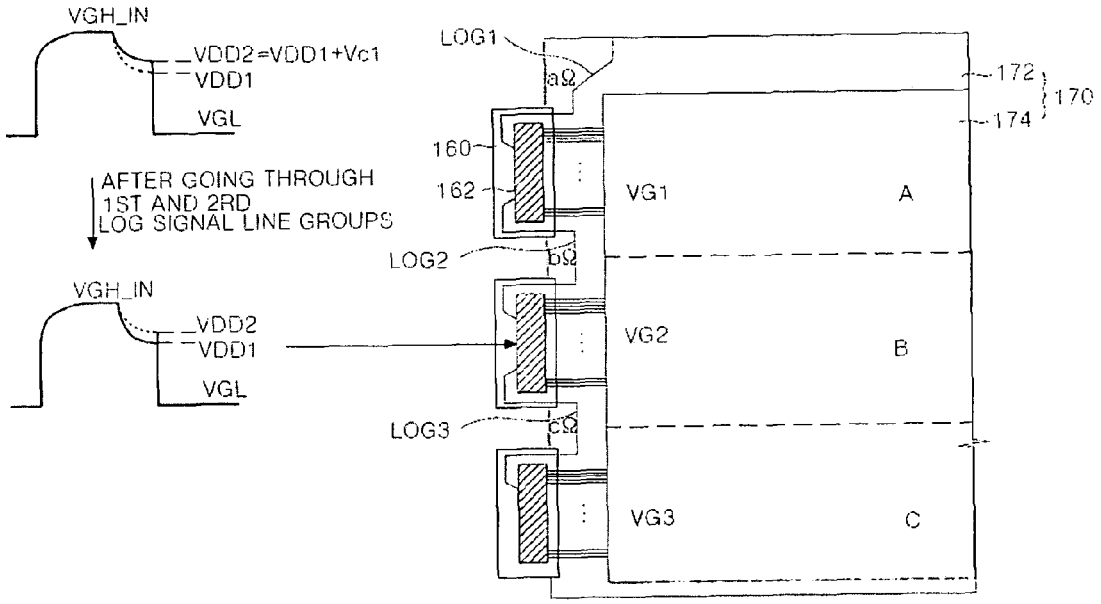
Figure 10C:
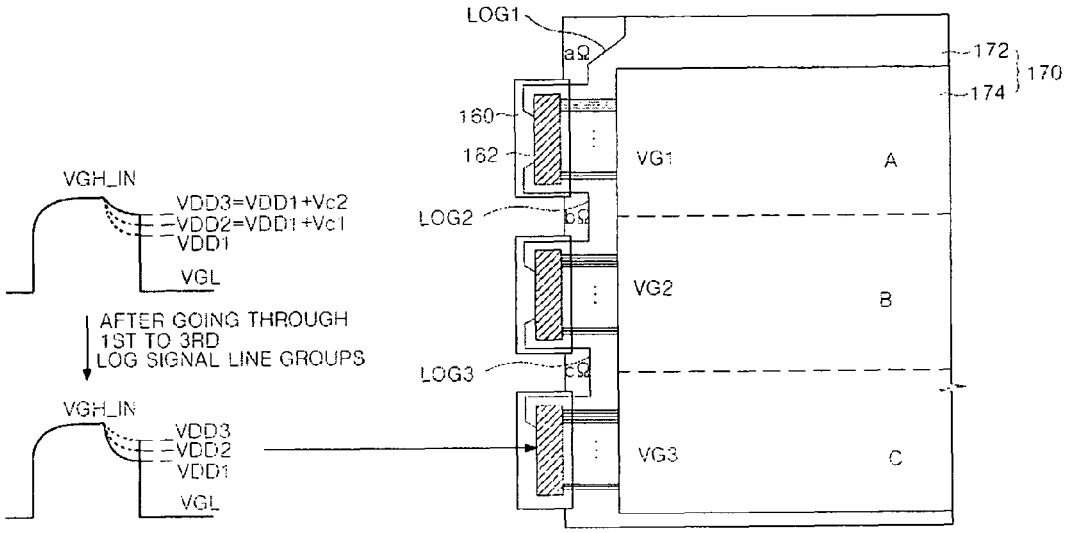

FIG. 10A to FIG. 10C illustrate a process in which the same scanning voltage is applied to the gate drive integrated circuits. First, the first gate drive IC 1621 receives the gate high voltage VGH from the DC-DC converter 200. Further, the first gate drive IC 1621 receives the first middle voltage VDD1 from the voltage controller 210 during an initial ⅓ period of the period control signal PCS. Thus, the first gate drive IC 1621 generates a scanning pulse in which the gate high voltage VGH drops into the first middle voltage VDD1 and thereafter drops into the gate low voltage VGL, as shown in FIG. 10A, during the initial ⅓ period of the period control signal PCS. Such a scanning pulse is sequentially applied to the gate lines connected to the first gate drive IC 1621 to drive each gate line.

The second gate drive IC 1622 receives the second middle voltage VDD2 higher, by the first direct current voltage Vc1, than the first middle voltage VDD1 from the voltage controller 210 during the next ⅓ period of the period control signal PCS. Such a second middle voltage VDD2 generates a voltage drop due to the first line resistances aΩ and second line resistance bΩ of the first LOG signal line group LOG1 and the second LOG signal line group LOG2 to be reduced by the first direct current voltage Vc1. As a result, even though the second gate drive IC 1622 is supplied with the second middle voltage VDD2 from the voltage controller 210, it results in being supplied with the first middle voltage VDD1. Thus, the second gate drive IC 1622 generates a scanning pulse in which the gate high voltage VGH drops into the first middle voltage VDD1 and thereafter drops into the gate low voltage VGL, as shown in FIG. 101B, during the next ⅓ period of the period control signal PCS. Such a scanning pulse is sequentially applied to the gate lines connected to the second gate drive IC 1622 to drive each gate line.

The third gate drive IC 1623 receives the third middle voltage VDD3 higher, by the second direct current voltage Vc2, than the first middle voltage VDD1 from the voltage controller 210 during the remaining ⅓ period of the period control signal PCS. Such a third middle voltage VDD3 generates a voltage drop due to the first to third line resistances aΩ–cΩ of the first to third LOG signal line groups LOG1 to LOG3 to be reduced by the second direct current voltage Vc2. As a result, even though the third gate drive IC 1623 is supplied with the third middle voltage VDD3 from the voltage controller 210, it results in being supplied with the first middle voltage VDD1. Thus, the third gate drive IC 1623 generates a scanning pulse in which the gate high voltage VGH drops into the first middle voltage VDD1 and thereafter drops into the gate low voltage VGL, as shown in FIG. 10C, during the remaining ⅓ period of the period control signal PCS. Such a scanning pulse is sequentially applied to the gate lines connected to the third gate drive IC 1623 to drive each gate line.

Consequently, each of the first to third gate drive IC's 1621 to 1623 is supplied with a scanning pulse in which the gate high voltage VGH drops into the first middle voltage VDD1 and thereafter drops into the gate low voltage VGL even though a voltage drop is generated due to each of the first to third line resistances aΩ, aΩ+bΩ or aΩ+bΩ+cΩ of the first to third LOG signal line groups LOG1 to LOG3. Thus, a difference is not generated among the gate signals VG1 to VG3 applied to the gate lines at the first to third horizontal blocks A to C driven by different gate drive IC's 162. Accordingly, generation of horizontal line stripes among the horizontal line blocks A to C and thus deterioration of picture quality is prevented.

As described above, according to the present invention, each of the gate drive integrated circuits connected to the LOG-type signal lines is supplied with a different scanning pulse set in advance. Accordingly, horizontal line stripes are prevented from being generated among the horizontal blocks driven by different gate drive IC's caused by an affect of the LOG-type signal lines and thus deterioration of picture quality is prevented.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display, comprising:

a liquid crystal display panel having liquid crystal cells arranged in a matrix defined by data lines and gate lines that cross each other, wherein a thin film transistor is provided in each respective cell adjacent to a crossing of a data line and a gate line for the respective cell;

a scanning voltage generator to generate scanning voltages that have different values, wherein the scanning voltages include a gate high voltage that is more than a threshold voltage of the thin film transistor, a plurality of middle voltages that is lower than the gate high voltage, and a gate low voltage that is lower than all the plurality of middle voltages and the threshold voltage of the thin film transistor;

a plurality of gate driving integrated circuits to generate scanning pulses using the scanning voltages and to supply the scanning pulse to the gate lines; and a switching circuit to switch the plurality of middle voltages from the scanning voltage generator and to apply the plurality of middle voltages to the plurality of gate driving integrated circuits, respectively; and a line-on-glass-type (hereafter, LOG-type) voltage line provided on a glass substrate of the liquid crystal display panel to apply the scanning voltage to the gate driving integrated circuits, wherein the scanning voltage generator generates the plurality of middle voltages that have different levels according to the plurality of gate driving integrated circuits, respectively, wherein the plurality of middle voltages are set to be different according to line resistance of the LOG-type voltage line connected with the plurality of gate driving integrated circuits, wherein the plurality of middle voltages increase as it increases the line resistance of the LOG-type voltage line for supplying the scanning voltage to each of the gate driving integrated circuits, and wherein the switching circuit divides a period, which is total a scanning time of all the gate lines, into a plurality of times corresponding to the plurality of gate driving integrated circuits, respectively, and supplies each middle voltage to the each gate driving integrated circuit during each time, which is a driving time of the each gate driving integrated circuit.

2. The liquid crystal display according to claim 1, wherein the gate driving integrated circuit supplies the gate high voltage to the gate line during a certain time and thereafter applies the middle voltage to the gate line, thereby generating a scanning pulse.

3. The liquid crystal display according to claim 1, wherein the scanning voltage generator generates the middle voltages as an nth middle voltage, an (n+1)th middle voltage and an (n+2)th middle voltage, and the nth middle voltage is supplied to the nth gate driving integrated circuit during a first time by a switching of the switching circuit; the (n+1)th middle voltage is supplied to the (n+1)th gate driving integrated circuit during a second time by a switching of the switching circuit; and the (n+2)th middle voltage is supplied to the (n+2)th gate driving integrated circuit during a third time by a switching of the switching circuit.

4. The liquid crystal display according to claim 3, wherein the first to third time are different time periods.

* * * * *